US011006221B2

(12) United States Patent
Sancisi

(10) Patent No.: US 11,006,221 B2
(45) Date of Patent: May 11, 2021

(54) ACOUSTIC PANEL ASSEMBLY

(71) Applicant: ASK INDUSTRIES SOCIETA' PER AZIONI, Monte San Vito (IT)

(72) Inventor: Carlo Sancisi, Chiaravalle (IT)

(73) Assignee: ASK INDUSTRIES SOCIETA' PER AZIONI, Monte San Vito (IT)

( * ) Notice: Subject to any disclaimer, the term of this patent is extended or adjusted under 35 U.S.C. 154(b) by 0 days.

(21) Appl. No.: 16/440,338

(22) Filed: Jul. 3, 2019

(65) Prior Publication Data

US 2020/0015019 A1 Jan. 9, 2020

(30) Foreign Application Priority Data

Jul. 9, 2018 (IT) ..... 102018000007041

(51) Int. Cl.

| | |
|---|---|
| ***H04R 9/02*** | (2006.01) |
| ***H04R 9/06*** | (2006.01) |
| ***H04R 7/04*** | (2006.01) |
| ***H04R 7/18*** | (2006.01) |
| ***H04R 9/04*** | (2006.01) |

(52) U.S. Cl.

CPC ..... *H04R 9/06* (2013.01); *H04R 7/04* (2013.01); *H04R 7/18* (2013.01); *H04R 9/025* (2013.01); *H04R 9/046* (2013.01)

(58) Field of Classification Search

CPC ..... H04R 7/04; H04R 7/045; H04R 9/047

See application file for complete search history.

(56) References Cited

U.S. PATENT DOCUMENTS

| | | | | |
|---|---|---|---|---|
| 6,192,136 | B1 * | 2/2001 | Azima | B42D 15/022 381/338 |
| 9,807,509 | B2 * | 10/2017 | Mao | H04R 9/025 |
| 10,499,160 | B2 * | 12/2019 | Lim | H04R 7/04 |
| 2003/0081799 | A1 | 5/2003 | Klasco et al. | |
| 2003/0081800 | A1 | 5/2003 | Klasco et al. | |
| 2005/0220320 | A1 * | 10/2005 | Kim | H04R 9/025 381/396 |
| 2011/0200204 | A1 | 8/2011 | Horigome | |
| 2018/0084346 | A1 * | 3/2018 | Yang | H04R 9/06 |

FOREIGN PATENT DOCUMENTS

| | | | |
|---|---|---|---|
| DE | 3123098 | A1 | 1/1983 |
| EP | 0847661 | A2 | 6/1998 |

OTHER PUBLICATIONS

Search Report Form IT237 "Written Opinion" dated Oct. 4, 2019, with reference to the Corresponding Priority Italian Patent Application No. 102018000007041.

* cited by examiner

*Primary Examiner* — Ryan Robinson

(74) *Attorney, Agent, or Firm* — Egbert, McDaniel & Swartz, PLLC

(57) ABSTRACT

An acoustic panel assembly includes: an acoustic panel; a magnetic circuit that generates a gap; and a voice coil disposed in the gap in order to move with the passage of electrical current. The voice coil is connected to the acoustic panel in order to move the acoustic panel in such a way to emit a sound. The magnetic circuit is disposed in correspondence of the voice coil in such a way to project in the front and in the back with respect to the acoustic panel.

12 Claims, 7 Drawing Sheets

ACOUSTIC PANEL ASSEMBLY

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention refers to an acoustic panel assembly.

2. Description of Related Art Including Information Disclosed Under 37 CFR 1.97 and 37 CFR 1.98

Acoustic panels, which are also known as Distributed Mode Loudspeakers (DML), reproduce the sound in a large audio frequency range in the so-called "distributed mode" by propagating "bending waves" through the body of the panel. An excitation device generates the bending and rippling of the panel, obtaining an acoustic response that is distributed in an audio frequency range.

With such an operation and sound generation mechanism, evidently the choice of the characteristics of the materials used for the panel, in terms of rigidity, dampening and self noise, is fundamental in order to obtain an audio response with good quality and high fidelity.

A much appreciated characteristic of the DML acoustic panels that differentiates them from the other loudspeakers is the emission of a non-directional diffused sound field over a wide audio frequency range. However, the acoustic panels are impaired by a poor low frequency reproduction.

Moreover, as it is known, until a given transition frequency, the movement of a loudspeaker membrane depends on the dimensions (diameter) of the membrane. Such a movement of the membrane is equivalent to a pistonic movement; in other words, all the points of the membrane are moved in phase.

For higher frequencies than the transition frequency, the sounds are reproduced by means of bendings and ripplings of the membrane, which tend to color the sound, reducing its fidelity, also in a disturbing way. Also in this case, a correct choice of the materials is fundamental to characterize the sound and ensure its fidelity.

As it is known, the traditional DML acoustic panels are stressed by means of exciters/shakers that are directly fixed to the body of the sound panel. The most common materials used for the panel are of laminated composite type, typically with honeycomb structure, meaning that a honeycomb core is glued in sandwich configuration on laminated sheets, which are known as "skins".

US2003/0081799 discloses materials that are suitable for improving the sound produced by an acoustic panel, regardless of the technical solutions used to excite the panel. US2003/0081799 suggests the most suitable materials in order to achieve some improvements compared to the prior art, i.e.: a better signal/noise ratio (S/N), a better extension in the frequency response, especially at low frequency, and a better power handling.

US2003/0081800 uses the precepts on the materials described in US2003/0081799 and discloses a solution for the sound excitation of the acoustic panel that uses technologies that are known in the construction of traditional loudspeakers. US2003/0081800 discloses construction elements that are typical of the loudspeaker technology, which allow for achieving additional improvements of the acoustic response, especially at low frequency. Such construction elements are: suspensions or elastic borders between planar membrane (panel) and external frame (basket), magnetic circuit supported by bridges (basket) that are joined with the frame, and mobile coil that is joined with the panel. In view of the above, a hybrid acoustic system is obtained, which operates as Distributed Mode Loudspeaker (DML) for low-power electrical signals; on the contrary, for high volume levels, and especially for low frequencies, because of the elastic suspension system of the external border, the panel operates in a pistonic mode, just like a traditional loudspeaker.

The acoustic panels have a smaller axial volume compared to the loudspeakers with conical membrane; for this reason, the acoustic panels are preferable and practically irreplaceable in case of mounting in spaces with a low depth. Such a smaller volume of the acoustic panel is particularly required for installations in vehicles that are generally provided with small spaces in the doors, in the backrest seats, in the roof/headliner, in the pillars that are used for fixing the windscreens and in the dashboard of the vehicles.

FIG. 1 shows an acoustic panel assembly according to the prior art, which is generally indicated with reference numeral 600.

A magnetic circuit (1) is supported by a bridge (2) that is firmly fixed to an external frame (3) that supports an acoustic panel (4) by means of an elastic border (5). A voice coil (6) is firmly fixed to the acoustic panel (4) by means of a cylindrical voice coil former (60). The voice coil is free to move inside a gap (T) generated by the magnetic circuit (1). When the voice coil (6) is crossed by electrical current and is immersed in the gap (T), the voice coil (6) receives a force (Lorentz force) that determines its movement. Therefore, the magnetic circuit (1) and the voice coil (6) operate as a driver to move the acoustic panel (4) in such a way to generate a sound.

Advantageously, the acoustic panel assembly (600) has a smaller volume compared to a traditional loudspeaker with conical membrane because the conical membrane is replaced by the planar acoustic panel (4).

However, the acoustic panel assembly (600) has a traditional magnetic circuit (1) that comprises a lower polar plate (T-Yoke) (10) provided with a core (11), an upper polar plate (12) and a magnet (13) disposed between the T-Yoke (10) and the upper polar plate (12).

Such a traditional magnetic circuit (1) needs to be completely disposed behind the panel, and in any case generates an axial volume that is added to the thickness of the panel and can be excessive, especially in the case of a small space, like the spaces that are available in cars.

DE3123098 discloses different embodiments of a membrane for electroacoustic transducer. FIGS. 1-4 of DE3123098 show a traditional voice coil obtained with a winding around a cylindrical ring connected to the membrane.

The transducer of FIGS. 5 and 6 of DE3123098 is not provided either with a magnetic unit or with a voice coil immersed in the gap of the magnetic unit. The excitation system of the panel is of electrostatic type, being generated by an electrical polarization field obtained by means of a generator with constant voltage and a resistance, which is modulated by an electrical voice signal. The electrical voice signal unbalances said electrical polarization field, creating attractive and repulsive forces on the two opposite sides of the panel that allow for the acoustic generation of the voice signal.

FIG. 7 of DE3123098 shows a traditional coil that is obtained by spirally winding a wire around a rigid cylindrical body, wherein overlapped layers of the wire of the coil are clearly shown. The configuration of the magnetic system, which is obtained with rings or blocks of magnetic material, is not very efficient because of the limited number of magnetic induction lines that are capable of radially passing through the voice coil.

WO97/09842 discloses different embodiments of acoustic panels. All solutions employ inertial devices, known as "shakers" or "exciters" as excitation elements of the panel. All embodiments show a traditional voice coil that is obtained by winding a conductive wire around a cylindrical surface. The figures of WO97/09842 clearly show the overlapped layers of wire in the voice coil.

FIGS. 9, 10, 11, 12, 16, and 17 of WO97/09842 disclose an acoustic panel in which the excitation system is obtained by means of shakers (exciters) with magnetic mobile system. In said devices the voice coil is fixed to the panel and the transmission of a signal to the panel is obtained by means of a vibration induced by the magnetic mobile system that receives a force from the interaction between its magnetic induction lines and the current that flows in the voice coil (Lorentz force).

US2011/0200204 discloses an acoustic panel in which the excitation device employs mechanical lever systems for transmitting the vibrations to the panel. The polarity and the layout of the magnets are such that, when the rectangular voice coil is crossed by the voice signal, the voice coil moves in a parallel direction to the plane of the magnets and in orthogonal direction to the central magnetic pole (T-Yoke). Such a transverse movement of the coil is transmitted to the panel by means of a complicated mechanical lever mechanism.

US2005/0220320 discloses a loudspeaker with a planar coil composed of a strip of conductive film deposited on a membrane in a spiral configuration, which can be obtained with the traditional technologies that are used to make printed circuits.

BRIEF SUMMARY OF THE INVENTION

The purpose of the present invention is to eliminate the drawbacks of the prior art, by disclosing an acoustic panel assembly with a small axial volume, which is efficient, effective and reliable.

Another purpose of the present invention is to disclose such an acoustic panel assembly that is provided with an excitation system and means that allow for the axial movement of the panel, in such a way to generate a good reproduction also at low frequencies.

These purposes are achieved according to the invention with the characteristics of the independent claim 1.

Advantageous embodiments of the invention appear from the dependent claims.

The acoustic panel assembly of the invention is defined in claim 1.

BRIEF DESCRIPTION OF THE SEVERAL VIEWS OF THE DRAWINGS

Additional features of the invention will appear clearer from the detailed description below, which refers to merely illustrative, not limiting embodiments, wherein.

DETAILED DESCRIPTION OF THE INVENTION

In the following description, the parts that are identical or correspond to the parts described above are identified with the same numerals, omitting their detailed description.

Figure 2:
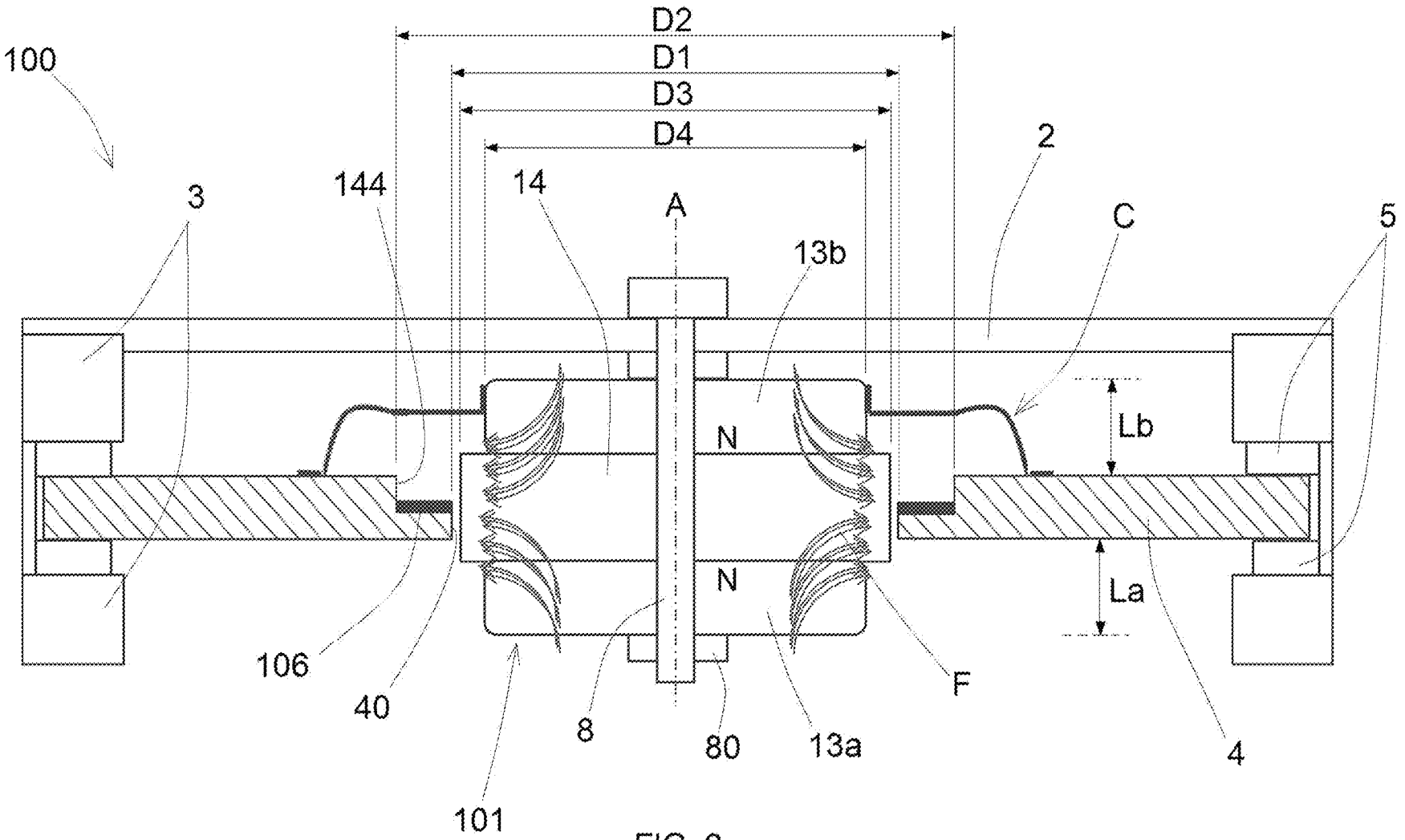
FIG. 2 is an axial sectional view of a first embodiment of the acoustic panel assembly according to the invention.

FIG. 2 shows an acoustic panel assembly (100) according to a first embodiment of the invention.

The acoustic panel assembly (100) comprises an acoustic panel (4) with a through hole (40) of cylindrical shape.

A voice coil (106) is disposed in the through hole (40) of the acoustic panel. The acoustic panel (4) operates directly as support to support the voice coil (106).

Figure 3:
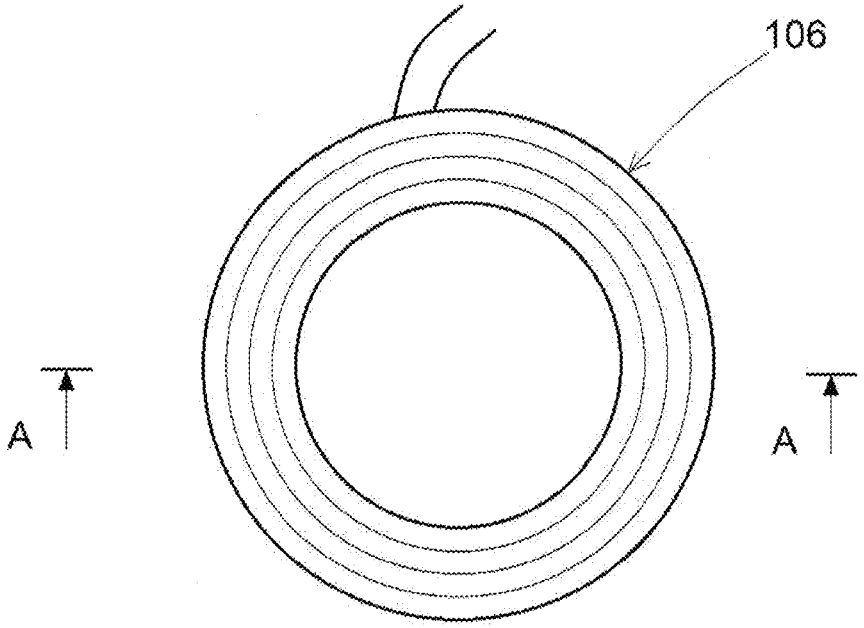
FIG. 3 is a plan view of a flat planar annular coil of the acoustic panel assembly FIG. 2.
Figure 3A:
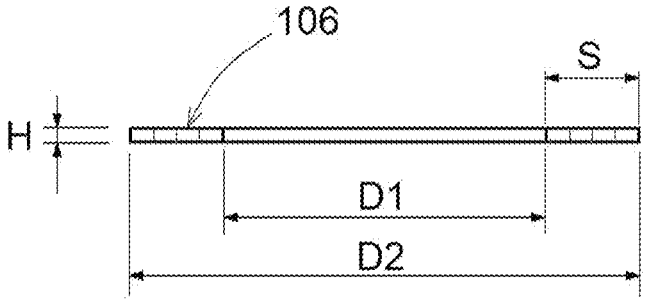
FIG. 3A is an axial sectional view taken along the plane A-A of FIG. 2.

With reference to FIGS. 3 and 3A, the voice coil (106) is of flat planar type and has an annular shape with an internal diameter (D1) and an external diameter (D2).

The voice coil (106) is obtained by winding a flat wire in annular planar configuration, without overlapped wires. In this case, the voice coil (106) has a small height because no wires are overlapped vertically. The ratio between the height (H) and the thickness (S) of the coil is lower than 1, preferably lower than ⅓. On the contrary, it must be noted that in traditional voice coils, such as the voice coil (6) shown in FIG. 1, the ratio between the height (H) and the thickness (S) of the coil is higher than 1, generally higher than 5.

The voice coil (106) is disposed in an annular seat (144) of the panel (4), around the hole (40) of the panel, in such a way that the plane of the coil is situated at half of the thickness of the panel.

Although not shown in the figures, the annular seat (144) can be omitted and the voice coil (106) can be simply disposed on the surface of the panel (4) around the hole (40). In such a case, the spacer (14) that acts as central pole of the magnetic circuit is mounted in such a way that the plane of the coil (106) is situated at half of the height of the spacer.

The voice coil (106) is immersed in a radial magnetic field generated by a magnetic circuit (101). FIG. 2 shows magnetic induction lines (F) generated by the radial magnetic field of the magnetic circuit (101).

The magnetic circuit (101) comprises two magnets (13*a*, 13*b*) that are coupled by means of a spacer (14) disposed between the two magnets (13*a*, 13*b*). The spacer (14) is disposed inside the voice coil (106) and has a height that is higher than the height of the voice coil. Therefore the spacer (14) has an external diameter (D3) that is lower than the internal diameter (D1) of the voice coil.

The magnets (13*a*, 13*b*) are disposed in a repulsive configuration; i.e. the north pole (N) of the first magnet (13*a*) faces the north pole (N) of the second magnet, or the south pole (S) of the first magnet (13*a*) faces the south pole (S) of the second magnet (13*b*).

The two magnets have an axis (A). The voice coil (106) has an annular shape with an axis that coincides with the axis (A) of the magnets.

According to its simplest embodiment, the spacer (14) can have a cylindrical shape and the magnets (13*a*, 13*b*) can have a disc-like shape with external diameter (D4). FIG. 2 shows the magnets (13*a*, 13*b*) with an external diameter (D4) that is lower than the external diameter (D3) of the spacer. However, the external diameter of the magnets may be equal to or higher than the external diameter of the spacer, but in any case lower than the internal diameter (D1) of the voice coil.

The spacer (14) can be conveniently obtained by combining magnetic and ferromagnetic materials and may have a geometry that is not necessarily cylindrical in order to increment the intensity of the magnetic induction field generated by the magnets (13*a*, 13*b*) and its uniformity in the movement area of the voice coil. In this way the spacer (14) acts as central magnetic pole. The height of the spacer (14) is determined by the need to allow for an axial movement of the voice coil (106) within a radial magnetic induction field that is as much as possible constant, along the entire dimension of the height of the spacer.

Such a dimension of the height of the spacer (14) is related to the frequencies of the signal to be reproduced and to its electrical power, as well as to the distortion generated by the acoustic system that is considered as acceptable.

The spacer (14) can be coated with a plate of a good electrical conductive material, such for example copper, in order to limit the effects of the eddy currents and consequently extend the acoustic response to the high frequencies.

For example, the magnetic circuit (101) is fixed to a bridge (2) by means of a threaded screw (8) that axially penetrates the magnets (13*a*, 13*b*), the spacer (14) and the bridge (2) and is tightened with a nut (80).

The bridge (2) is fixed to a frame (3) that peripherally supports the acoustic panel (4). Elastic borders (5) are mounted in the frame (3) to elastically suspend the acoustic panel (4).

The magnetic circuit (101) is disposed in the through hole (40) of the panel in such a way to project in the front and in the back relative to the acoustic panel. In particular, the magnetic circuit (101) has a front portion that projects frontally from the acoustic panel by a length (La), and a back portion that projects in the back from the acoustic panel by a length (Lb). When the voice coil (106) is mounted in an annular seat (144) obtained in the panel, the length (La) of the front portion is equal to the length (Lb) of the back portion of the magnetic circuit. A spider (C) can be used to maintain a stable centering between the magnetic circuit (101) and the voice coil (106) and to modulate the rigidity of the elastic borders (5). For example, the spider (C) can be disposed between the panel (4) and the second magnet (13*b*).

Figure 1:
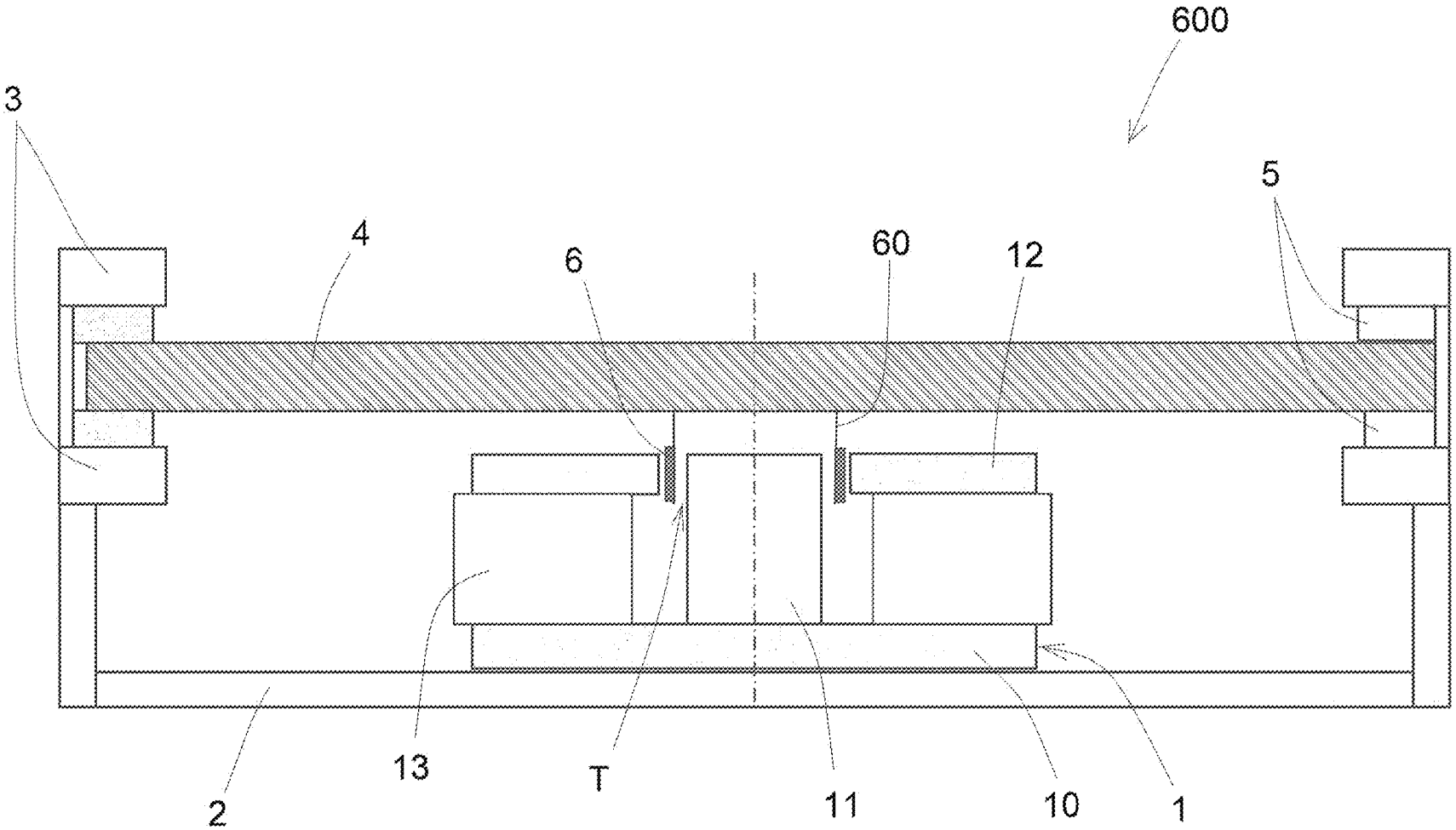
FIG. 1 PRIOR ART
FIG. 1 is a sectional axial view of an acoustic panel assembly according to the prior art.

The acoustic panel assembly (100) of FIG. 2 has a lower back volume compared to the acoustic panel assembly (600) of FIG. 1. In fact, the acoustic panel assembly (100) comprises a magnetic circuit (101) that is more compact than the magnetic circuit (1) of the acoustic panel assembly (600). Moreover, the magnetic circuit (101) of the acoustic panel assembly (100) is symmetrically disposed, half in the front and half in the back of the acoustic panel (4) in a sandwich configuration.

In the example of FIG. 2, the internal diameter (D1) of the voice coil (106) is higher than the external diameter (D4) of the magnets (13*a*, 13*b*). The voice coil (106) is disposed on the exterior of the spacer (14), at half of its thickness, and is disposed on the exterior of the volume of the magnets (13*a*, 13*b*) in such a way to allow for a high travel of the voice coil (106), thus preventing the voice coil from interfering with elements of the magnetic circuit and avoiding the generation of noise and distortion.

For illustrative purposes FIG. 2 shows a voice coil (106) that is inserted in the annular seat (144) obtained in the panel (4). The thickness of the voice coil (106) is considerably lower than the thickness of the spacer (14), in such a way that, during the movement of the panel (4), the voice coil (106) is mainly disposed within the thickness of the spacer (14), i.e. in the area of radial magnetic field with the highest uniformity.

The voice coil (106) used in this case is of flat wire type, like the one of FIGS. 3 and 3A. Alternatively, the voice coil (106) can be obtained with traditional wires with round section, but with a total thickness of the winding (H) lower than the height of the spacer (14), in such a way that, according to the electrical power, to the frequency content of the voice signal and to the accepted distortion, the movement of the voice coil (106) is as much as possible contained within the thickness of the spacer with a more uniform radial magnetic field.

Figure 4:
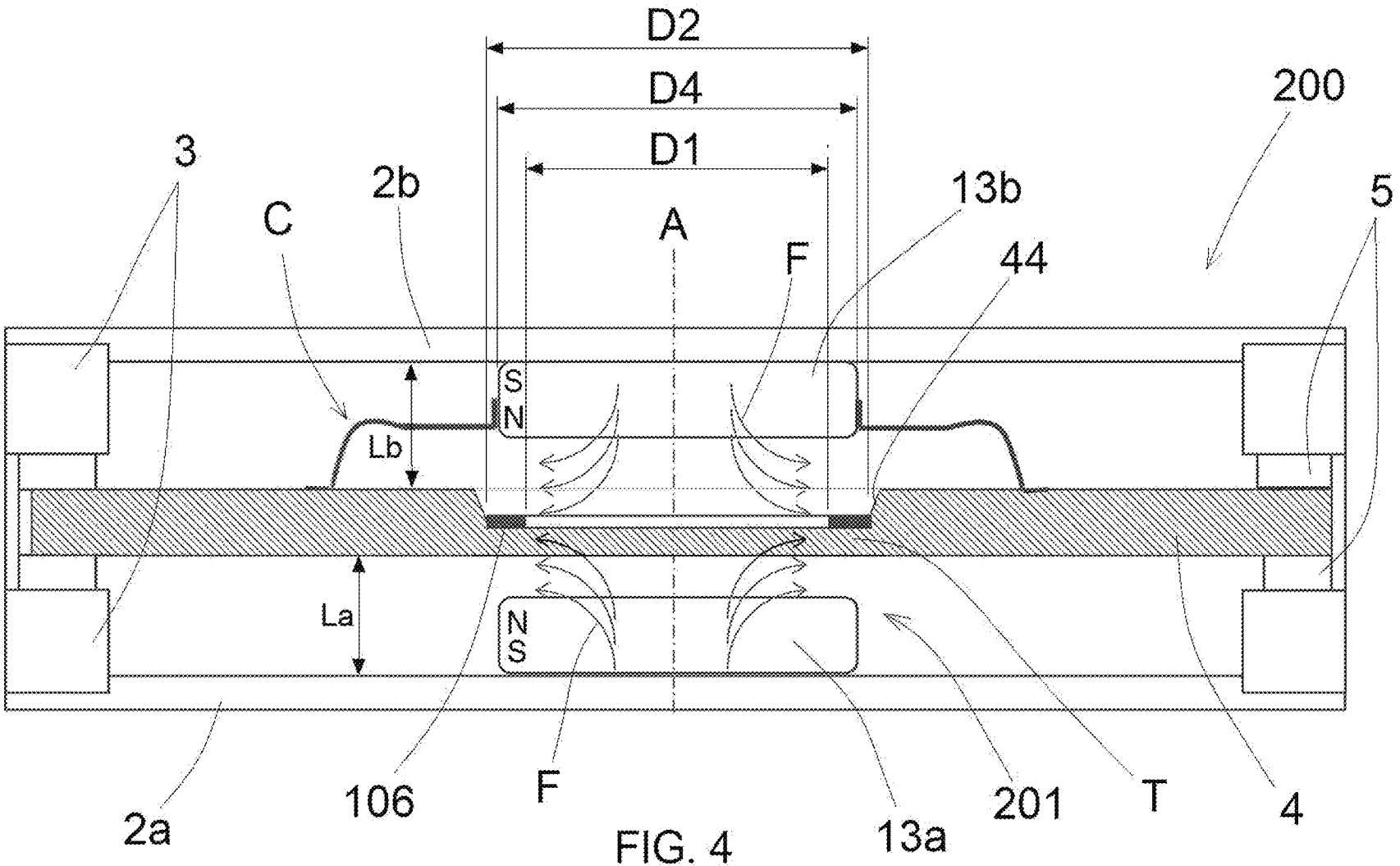
FIG. 4 is an axial sectional view of a second embodiment of the acoustic panel assembly according to the invention.

FIG. 4 shows an acoustic panel assembly (200) according to a second embodiment of the invention.

The acoustic panel assembly (200) comprises a voice coil (106) of flat planar type that is disposed in a recessed seat (44) obtained in the panel (4). The depth of the recessed seat (44) can be such that the plane of the voice coil (106) is at half of the thickness of the panel (4).

The acoustic panel assembly (200) comprises a magnetic circuit (201) with two magnets (13*a*, 13*b*) disposed in repulsive configuration. The voice coil (106) is disposed between the two magnets (13*a*, 13*b*). The magnets (13*a*, 13*b*) are fixed to bridges (2*a*, 2*b*) disposed behind and in front of the panel (4). The bridges (2*a*, 2*b*) are fixed to a frame (3) that peripherally supports the acoustic panel (4) by means of elastic borders.

The flat, planar, annular voice coil (106) shown in FIGS. 3 and 3A has a lower thickness than the panel (4), and therefore can be positioned in the recessed seat (44) obtained in the panel according to a median plane relative to the thickness of the panel. In view of the above, because of the lower thickness of the voice coil, the two magnets (13*a*, 13*b*) can be moved closer, thus additionally reducing the axial volume of the magnetic circuit (201), and increasing the magnetic induction because of the closer position of the two magnets (13*a*, 13*b*).

In such a case, the external diameter (D4) of the magnets (13*a*, 13*b*) is comprised between the internal diameter (D1) and the external diameter (D2) of the voice coil.

Figure 5:
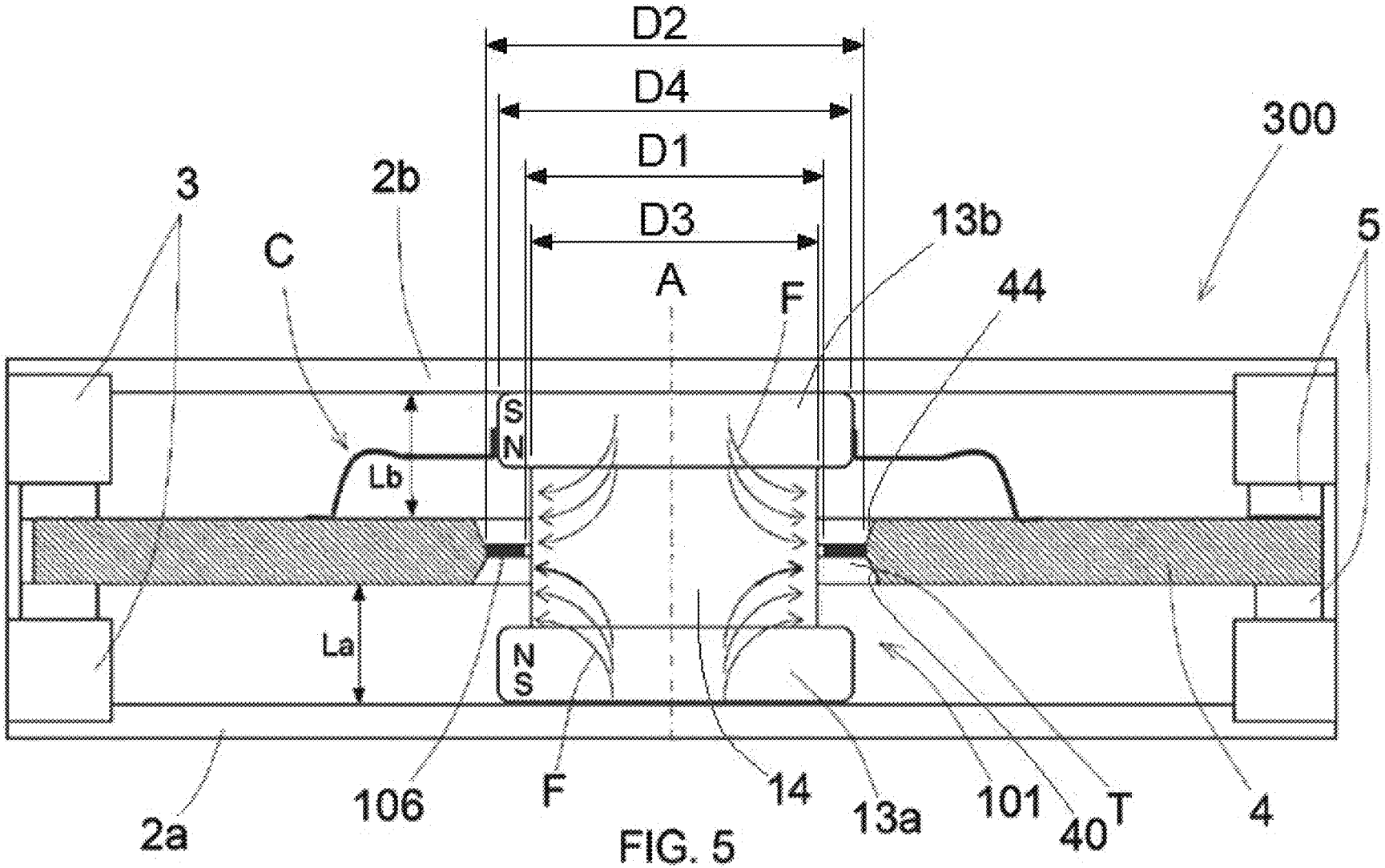
FIG. 5 is an axial sectional view of a third embodiment of the acoustic panel assembly according to the invention.

FIG. 5 shows an acoustic panel assembly (300) according to a third embodiment of the invention.

The acoustic panel assembly (300) comprises a panel (4) with a hole (40). The flat, planar voice coil (106) is identical to the one shown in FIGS. 3 and 3A. The voice coil (106) is fixed to the panel (4) in the hole (40). A peripheral part of the voice coil is fixed to an annular border of the panel (4) that defines the hole (40) at half thickness of the panel. Obviously, the hole (40) can be provided with a surface shaped as a planar circular crown that is joined with the panel, where the voice coil (106) is glued.

The magnetic circuit (101) comprises a spacer (14) disposed between the two magnets (13*a*, 13*b*) and inside the voice coil (106).

In such a case, the external diameter (D4) of the two magnets (13*a*, 13*b*) is higher than the external diameter (D3) of the spacer (14) and the external diameter (D4) of the magnets (13*a*, 13*b*) is comprised between the internal diameter (D1) and the external diameter (D2) of the voice coil (106).

Figure 6:
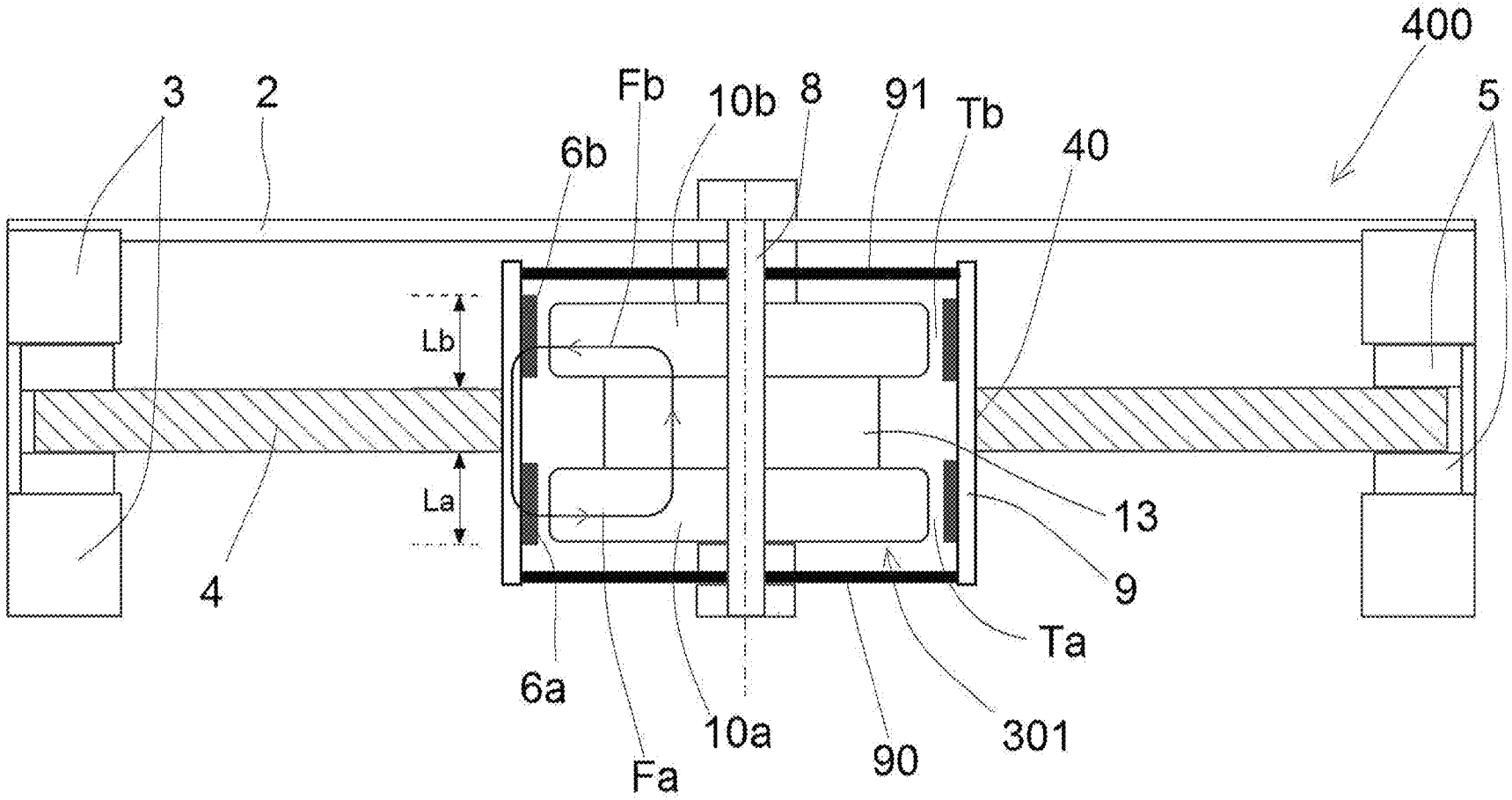
FIG. 6 is an axial sectional view of a fourth embodiment of the acoustic panel assembly according to the invention.

FIG. 6 shows an acoustic panel assembly (400) according to a fourth embodiment of the invention.

The acoustic panel assembly (400) comprises a magnetic circuit (301) with a magnet (13) disposed between a first polar plate (10*a*) and a second polar plate (10*b*). The magnetic circuit (301) is fixed centrally to a bridge (2) by means of a threaded screw (8) that axially penetrates the bridge (2), the second polar plate (10*b*), the magnet (13) and the first polar plate (10*a*). The threaded screw (8) is fixed with nuts. The bridge (2) is fixed to a frame (3) that peripherally supports the acoustic panel (4). Elastic borders (5) are mounted in the frame (3) to elastically suspend the acoustic panel (4).

A cylinder (9) is disposed in the through hole (40) of the acoustic panel and is fixed to the acoustic panel (4) in such a way that the magnetic circuit (301) is disposed inside the cylinder (9). The cylinder (9) is preferably made of ferromagnetic material.

Flat suspensions (90, 91), such as for example springs or spiders, elastically connect the cylinder (9) to the magnetic circuit (301) to ensure a centering of the magnetic circuit (301) inside the cylinder (9). The suspensions (90, 91) are connected to the threaded screw (8) disposed in axial direction in the magnetic circuit (301).

A first voice coil (6*a*) is fixed to the internal surface of the cylinder (9) in correspondence of the first polar plate (10*a*).

A second voice coil (6*b*) is fixed to the internal surface of the cylinder in correspondence of the second polar plate (10*b*).

Also this configuration is a sandwich-like configuration, in which the acoustic panel (4) is disposed along a median plate relative to the height of the cylinder (40) that encloses the magnetic circuit (301).

The two voice coils (6*a*, 6*b*) are powered with currents with opposite direction. For example, in the first voice coil (6*a*) the current circulates in anti-clockwise direction. On the contrary, in the second voice coil (6*b*) the current circulates in clockwise direction in order to use the Lorentz force generated in the lower and upper gaps (Ta, Tb) where magnetic induction lines (Fa, Fb) have an opposite direction.

In the embodiments of FIGS. 2, 4 and 5, annular elements preferably of ferromagnetic material, can be used and conveniently disposed outside the perimeter of the voice coil and firmly disposed on the panel in optimized positions for the different configurations, in order to increase the intensity of the magnetic induction field and its uniformity in the movement area of the voice coil.

FIGS. 2, 4, 5 and 6 show a single driver disposed in a position of the acoustic panel (4). Such a driver comprises only one magnetic circuit (101; 201; 301) and at least one voice coil (106; 6*a*, 6*b*) associated with the magnetic circuit. However, the acoustic panel assembly of the invention can comprise two or more drivers disposed in different positions of the panel.

FIGS. 7A, 7B, 7C, 7D, 7E and 7F show different solutions of elastic borders (5; 105; 205; 305; 405; 505) to elastically suspend the acoustic panel (4) to the frame (3) and allow for a better pistonic operation of the acoustic panel (4).

Figure 7A:
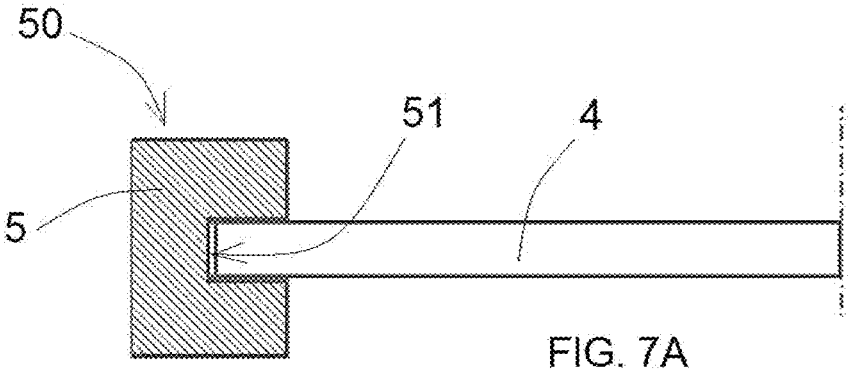
FIGS. 7A, 7B, 7C, 7D, 7E and 7F are sectional views of different embodiments of elastic borders of the acoustic panel assembly according to the invention.

FIG. 7A shows an elastic border (5) with a body (50) fixed to the frame (3) and a U-shaped seat (51) that receives a peripheral part of the acoustic panel (4).

Figure 7B:
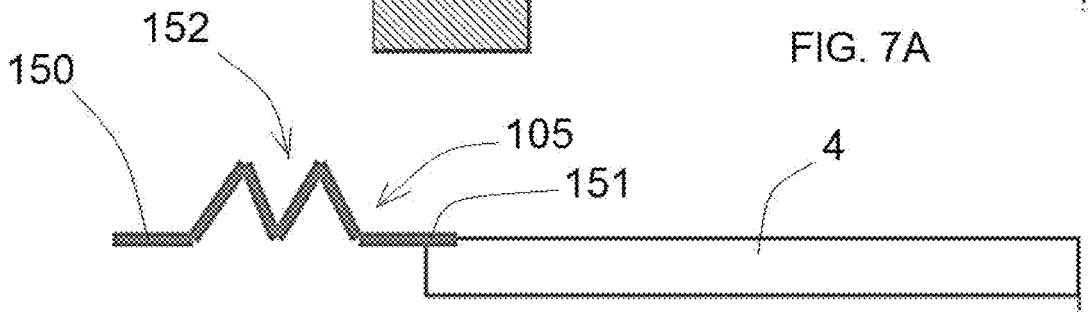

FIG. 7B shows an elastic border (105), also defined as border with triangular profile, with a first end (150) fixed to the frame (3), a second end (151) fixed to a peripheral part of the acoustic panel (4) and an intermediate portion (152) with M-shaped section.

Figure 7C:
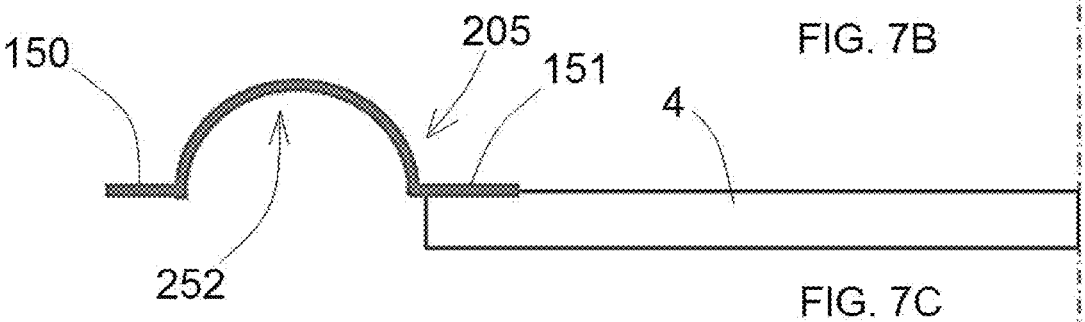

FIG. 7C shows an elastic border (205) with a first end (150) fixed to the frame (3), a second end (151) fixed to a peripheral part of the acoustic panel (4) and an intermediate portion (252) with a semi-circumferential section and downward concavity.

Figure 7D:
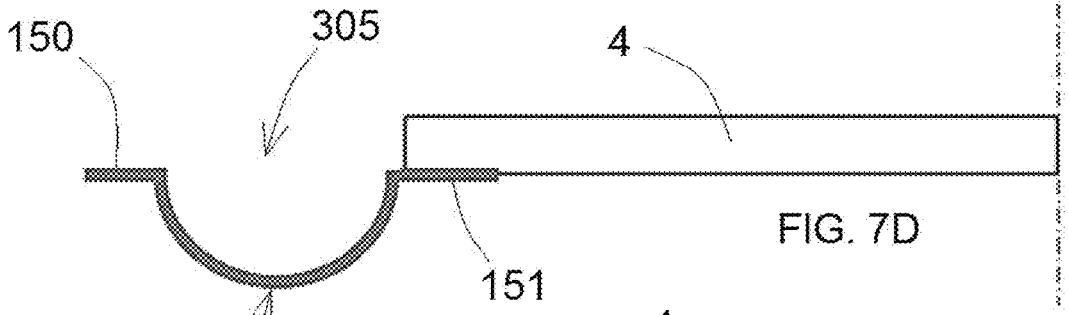

FIG. 7D shows an elastic border (305) with a first end (150) fixed to the frame (3), a second end (151) fixed to a peripheral part of the acoustic panel (4) and an intermediate portion (352) with a semi-circumferential section and upward concavity.

Figure 7E:
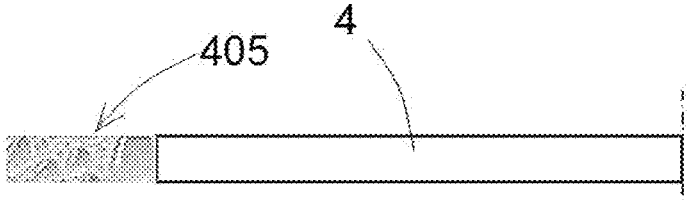

FIG. 7E shows a planar elastic border (405) that is foamed and disposed around the perimeter of the panel (4).

Figure 7F:
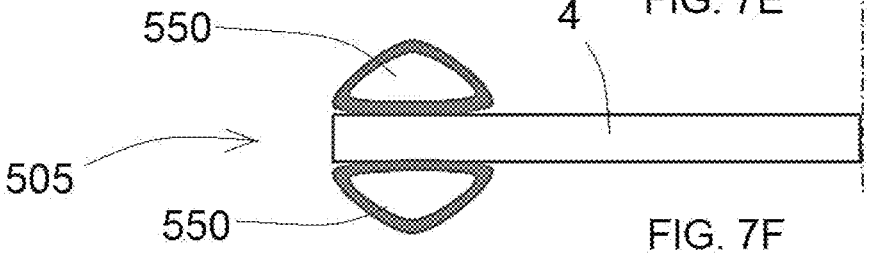

FIG. 7F shows an elastic border (505) comprising two supports (550) disposed above and under the panel (4). The supports (550) are elastic tubular elements that are filled with air in such a way to act as shock-absorbers.

It is also possible to elastically suspend only some perimeter regions of the acoustic panel (4), according to the acoustic features of the project requirements.

Numerous equivalent variations and modifications can be made to the present embodiments of the invention, which are within the reach of an expert of the field, falling in any case within the scope of the invention as disclosed by the appended claims.

I claim:

1. An acoustic panel assembly comprising:

an acoustic panel;

a magnetic circuit that generates a gap;

a voice coil disposed in said gap in order to move with a passage of an electrical current, said voice coil being connected to said acoustic panel in order to move said acoustic panel to emit a sound, wherein said magnetic circuit comprises a first magnet disposed in a forward position relative to said acoustic panel and a second magnet disposed in a rearward position relative to said acoustic panel, wherein the first and second magnets are disposed in a repulsive configuration, wherein each of the first and second magnets has a circular shape and an axis and an external diameter, wherein said voice coil is annular with an internal diameter and an external diameter and an axis, wherein the axis of said voice coil coincides with the axis of the first and second magnets, the external diameter of said voice coil being greater than the external diameter of the first and second magnets;

at least one bridge fixed to said magnetic circuit and to a frame fixed to a peripheral part of said acoustic panel by at least one elastic border, wherein said acoustic panel has a through hole in which said magnetic circuit is inserted, said voice coil being fixed to said acoustic panel around the through hole of said acoustic panel, wherein said magnetic circuit comprises a spacer disposed between the first and second magnets such that voice coil is disposed around the spacer; and a pin axially crossing the first and second magnets, the spacer and said at least one bridge in order to fix said magnetic circuit to said at least one bridge.

2. The acoustic panel assembly of claim 1, wherein said magnetic circuit has a front part that protrudes frontally from the acoustic panel by a first length and a back part that protrudes rearwardly from said acoustic panel by a second length, wherein the first length is equal to the second length.

3. The acoustic panel assembly of claim 1, wherein said voice coil is planar, said voice coil having turns made of flat wires and not overlapped in height.

4. The acoustic panel assembly of claim 1, wherein said voice coil is fixed in an annular seat of said acoustic panel around the through hole of said acoustic panel.

5. The acoustic panel assembly of claim 1, wherein the external diameter of the first and second magnets is less than the internal diameter of said voice coil.

6. The acoustic panel assembly of claim 1, wherein said at least one bridge comprises at least two bridges, wherein the first magnet and the second magnet are connected to corresponding bridges of the at least two bridges and are disposed respectively in a front and in a back of said voice coil.

7. The acoustic panel assembly of claim 6, wherein the external diameter of the first and second magnets is between the internal diameter and the external diameter of said voice coil.

8. An acoustic panel assembly comprising:

an acoustic panel;

a magnetic circuit that generates a gap;

a voice coil disposed in said gap in order to move with a passage of an electrical current, said voice coil being connected to said acoustic panel in order to move said acoustic panel to emit a sound, wherein said magnetic circuit comprises a first magnet disposed in a forward position relative to said acoustic panel and a second magnet disposed in a rearward position relative to said acoustic panel, wherein the first and second magnets are disposed in a repulsive configurations, wherein each of the first and second magnets has a circular shape and an axis and an external diameter, wherein said voice coil is annular with an internal diameter and an external diameter and an axis, wherein the axis of said voice coil coincides with the axis of the first and second magnets, the external diameter of said voice coil is greater than the external diameter of the first and second magnets, wherein the first and second magnets are connected to corresponding bridges and are disposed respectively in a front and a back of said voice coil, wherein said voice coil is disposed in a non-through recessed seat of said acoustic panel such that a plane of said voice coil is disposed at half of a thickness of said acoustic panel.

9. An acoustic panel assembly comprising:

an acoustic panel;

a magnetic circuit that generates a gap; and a pair of voice coils disposed in the gap in order to move with a passage of an electrical current, said pair of voice coils being connected to said acoustic panel in order to move said acoustic panel in order to emit a sound, wherein said magnetic circuit comprises a magnet disposed between a first polar plate and a second polar plate, said acoustic panel assembly comprising:

a cylinder fixed to said acoustic panel and disposed inside a through hole of said acoustic panel such that said magnetic circuit is contained inside said cylinder, said pair of voice coils comprising:

a first voice coil fixed to an internal surface of said cylinder in correspondence to the first polar plate; and a second voice coil fixed to the internal surface of said cylinder in correspondence to the second polar plate.

10. The acoustic panel assembly of claim 9, further comprising:

a plurality of elastic suspensions that connect said cylinder to said magnetic circuit.

11. The acoustic panel assembly of claim 9, wherein the first polar plate is disposed in front position relative to said acoustic panel and the second polar plate is disposed in rear position relative to said acoustic panel.

12. The acoustic panel assembly of claim 9, wherein said magnetic circuit has a front part that protrudes frontally from said acoustic panel by a first length and a back part that protrudes rearwardly from said acoustic panel by a second length, wherein the first length is equal to the second length.

* * * * *